US006609624B2

(12) United States Patent
Goto et al.

(10) Patent No.: US 6,609,624 B2
(45) Date of Patent: Aug. 26, 2003

(54) CAP BODY OF BEVERAGE CONTAINER

(75) Inventors: Takashi Goto, Tokyo (JP); Yasuhiro Kowa, Tokyo (JP); Hatsumoto Kunio, Tokyo (JP); Matsuyama Shin, Tokyo (JP)

(73) Assignee: Nippon Sanso Corporation, Tokyo (JP)

( * ) Notice: Subject to any disclaimer, the term of this patent is extended or adjusted under 35 U.S.C. 154(b) by 0 days.

(21) Appl. No.: 09/938,985

(22) Filed: Aug. 24, 2001

(65) Prior Publication Data

US 2002/0040909 A1 Apr. 11, 2002

(30) Foreign Application Priority Data

Sep. 26, 2000 (JP) ..... 2000-291653
May 25, 2001 (JP) ..... 2001-157162

(51) Int. Cl.[7] ..... A47G 19/22
(52) U.S. Cl. ..... 220/259.1; 220/835; 220/709
(58) Field of Search ..... 220/259.1, 254.3, 220/833, 835, 709, 705, 711, 714; 222/528–530

(56) References Cited

U.S. PATENT DOCUMENTS 2,844,267 A * 7/1958 Petriccione ..... 239/33
5,259,538 A * 11/1993 Tardif ..... 222/528
5,273,172 A * 12/1993 Rossbach et al. ..... 220/705
5,346,081 A * 9/1994 Lin ..... 220/709
5,897,013 A * 4/1999 Manganiello ..... 220/254.3
6,196,413 B1 * 3/2001 Tung ..... 220/709
6,276,560 B1 * 8/2001 Belcastro ..... 220/709
6,279,773 B1 * 8/2001 Kiyota ..... 220/709

FOREIGN PATENT DOCUMENTS

JP 4-4577 2/1992

* cited by examiner

*Primary Examiner*—Nathan J. Newhouse
(74) *Attorney, Agent, or Firm*—Merchant & Gould P.C.

(57) ABSTRACT

A cap body of beverage container wherein a lid plate of lid body forming a connection mouth at a drinking straw member is mounted with an air hole between a hinge axle for rotatively supporting a cap and the connection mouth, and a straw unit for being connected to the connection mouth of the drinking straw member is formed thereunder with a closing unit for covering the air hole, while the cap is disposed with a bend member for bending the drinking straw member and a blocking protruder for blocking the air hole via the closing unit, whereby the drinking straw member can be bent to enable to close the cap with one touch operation and to surely block the air hole.

5 Claims, 7 Drawing Sheets

CAP BODY OF BEVERAGE CONTAINER

BACKGROUND OF THE INVENTION

1. Field of the Invention

The present invention relates to a cap body of beverage container adapted to enable to drink beverage within a container body through a straw member mounted at a cap body blocking an opening at the container body.

2. Description of the Prior Art

By way of example, a cap body of a beverage container disclosed in a Japanese Utility Model Gazette for Japanese Utility Model laid-open publication No. Hei 4-4577 includes a lid body for forming a connection mouth of drinking straw member and an air hole at a lid plate blocking an opening of a container body and for being threadably and releasably mounted at an opening of a container body, a cap rotatively mounted at the lid body via a hinge axle for covering the lid plate, a beverage mouth bobbingly installed at the cap and a drinking straw member made of a flexible tube connecting between the beverage mouth and the connection mouth, where the straw member is bent when the cap is closed and simultaneously the air hole is blocked, and when the cap is opened, the beverage mouth at a tip end of the straw member is protruded.

However, there is a problem in the structure thus described in that, when the cap is to be closed, the cap cannot be closed at one touch operation because the beverage mouth must be pressed in by a hitching member of the cap to bend the tube. There is another problem in that, although the air hole is blocked by the tube connected to the beverage mouth, the air hole cannot be completely blocked in case the tube is twistedly connected to thereby let the tube bend, not in completely bent way but in deformedly bent way.

There is still another problem in that, because the air hole is distanced from the hinge axle, accurate works on parts such as cap, hinge axle, hinge axle support unit at the lid body and the like are required to fully block the air hole when the cap is to be closed.

The present invention is disclosed to provide a cap body of beverage container adapted to enable to bend a drinking straw member and to close a cap with one touch operation, and to completely block an air hole.

SUMMARY OF THE INVENTION

In accordance with the object of the present invention, there is provided a cap body of beverage container, the cap body including a lid body for forming a connection mouth of a drinking straw member and an air hole at a lid plate for blocking an opening of a container body and for being threadably and releasably mounted at an opening of a container body, a cap rotatively mounted at the lid body via a hinge axle for covering the lid plate, where the drinking straw member is bent and simultaneously the air hole is blocked when the cap is to be closed, wherein means of claim 1 comprises:

the lid plate forming the air hole between the connection mouth and the hinge axle;

the drinking straw member forming a plate-shaped closing unit for covering an upper side of the air hole at a lower end of the drinking straw member connecting to the connecting mouth; and the cap forming a bend member for bending the drinking straw member and a closing protruder for blocking the air hole via the closing unit;

wherein means of claim 2 comprises:

the drinking straw member forming a prominent unit along an axial direction touching a bend member; and the lid plate forming a recess having a smaller area than that of the closing unit about the air hole thereabove and simultaneously forming a flesh attaching unit about the air hole.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

Figure 1:
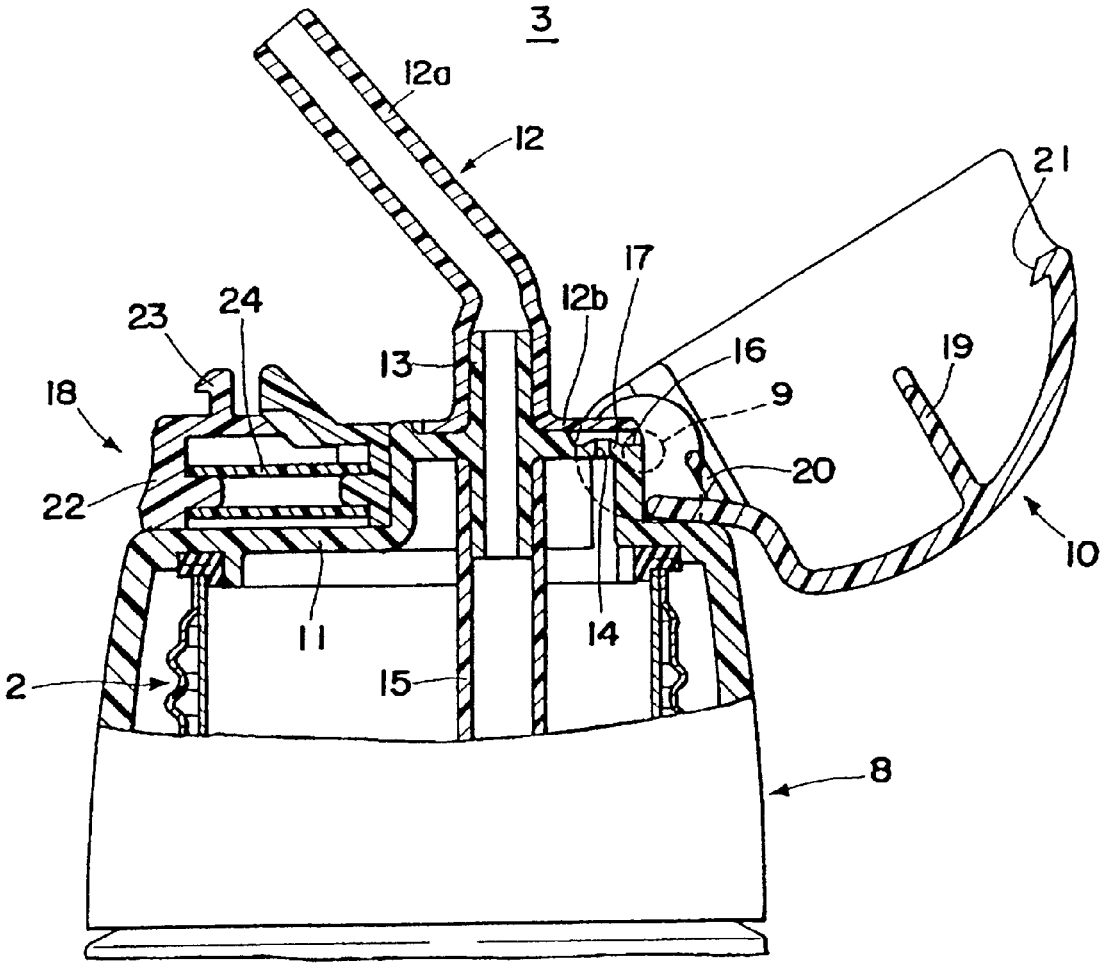
FIG. 1 is a sectional view of a cap body where a cap is opened according to a first embodiment of the present invention.
Figure 2:
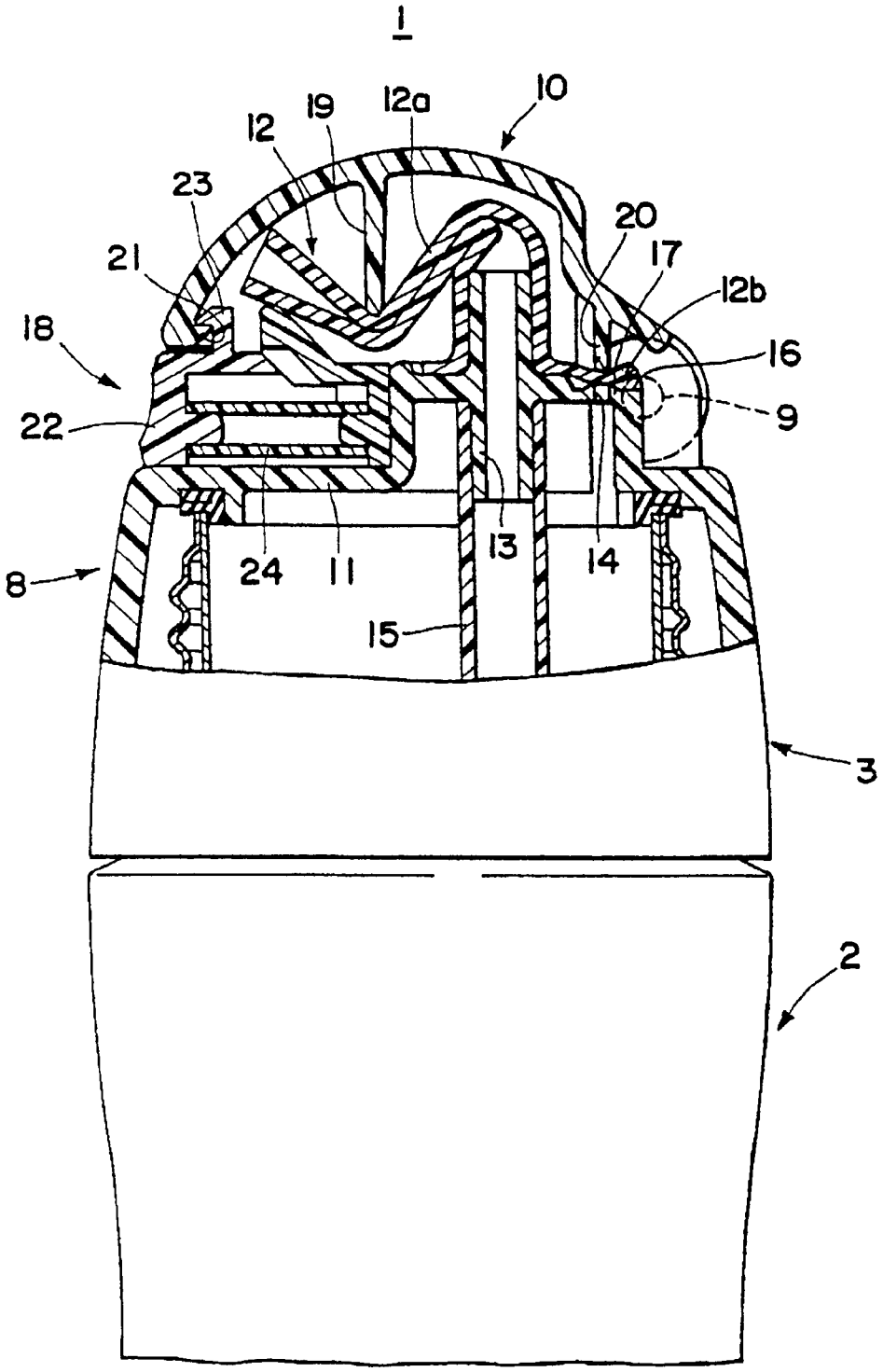
FIG. 2 is a sectional view of a cap body where a cap is closed according to the first embodiment of the present invention.
Figure 3:
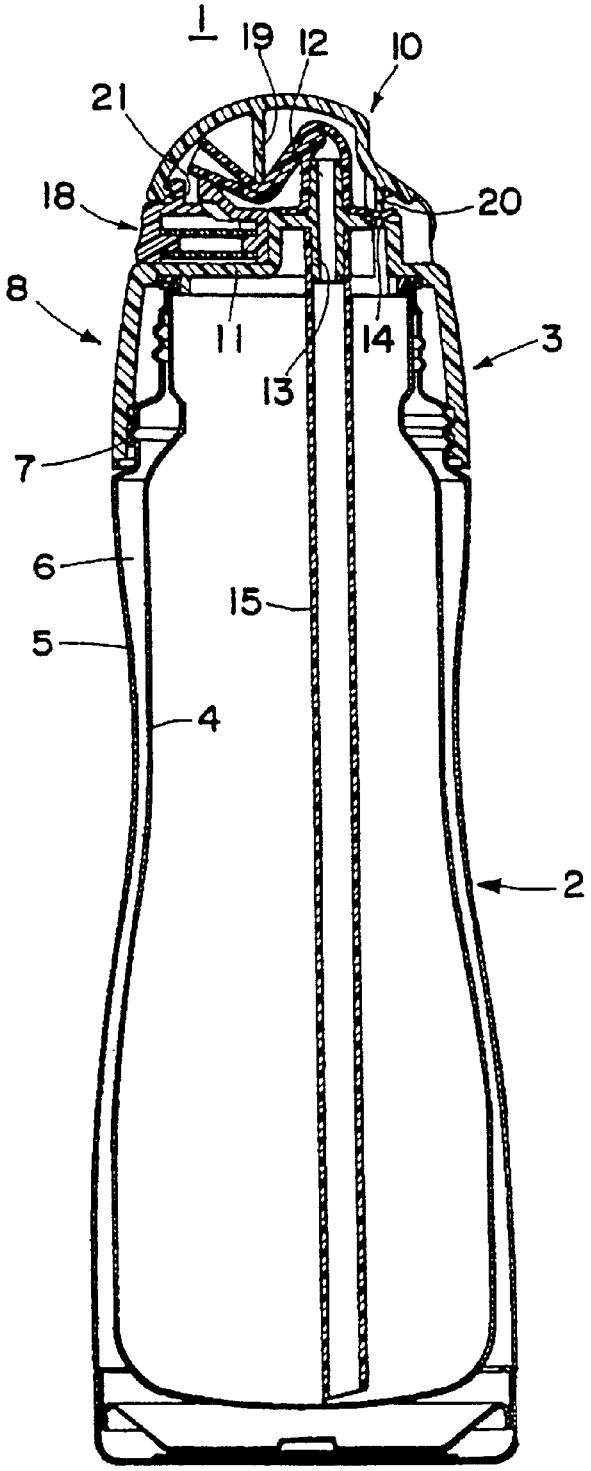
FIG. 3 is a sectional view of a beverage container according to the first embodiment of the present invention.
Figure 4:
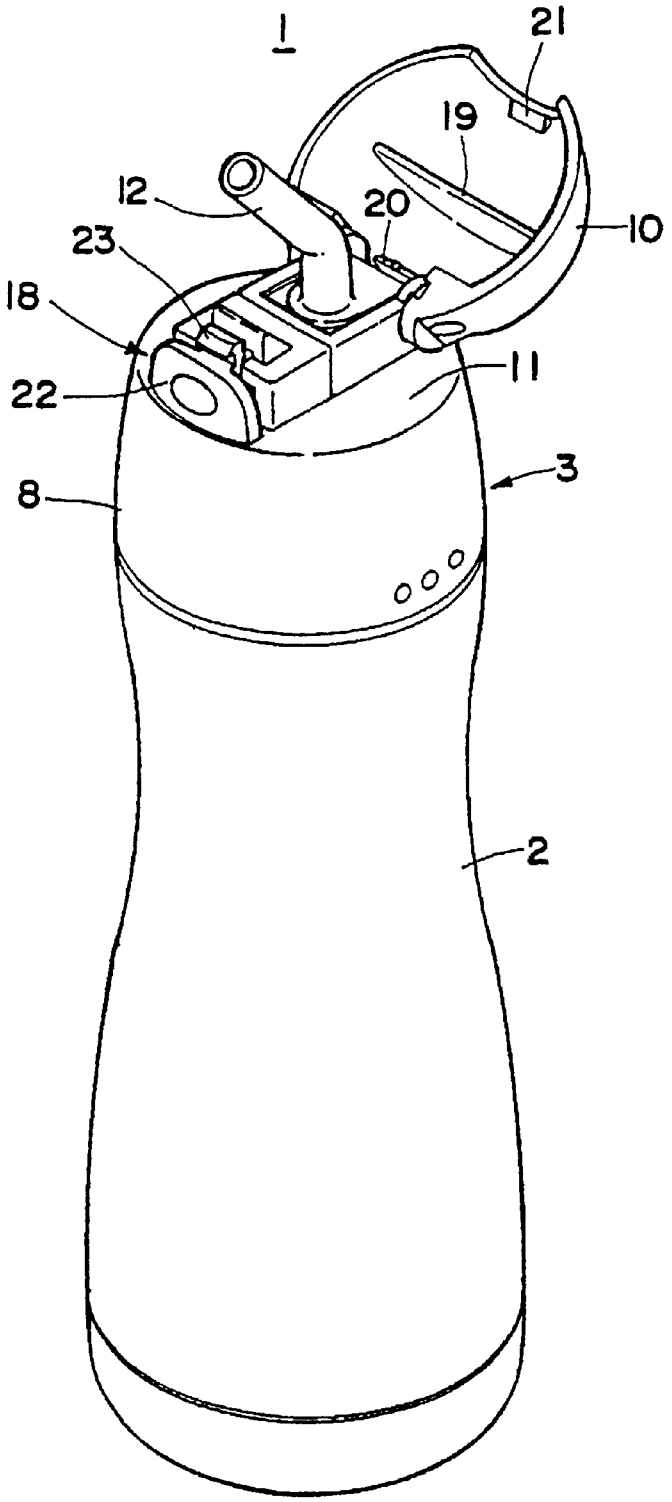
FIG. 4 is a perspective view of a beverage container according to the first embodiment of the present invention.

Now, preferred embodiments of the present invention will be described with reference to the accompanying drawings.

FIGS. 1 to 4 illustrate the first embodiment of the present invention, where a beverage container 1 includes a container body 2 of heat-insulating structure and a cap body 3 releasably mounted on the container body 2. The container body 2, which is made of an integral coupling between upper ends of a metallic outer container 5 and a metallic inner container 4 having an opening at an upper side thereof, has an heat-insulating portion 6 of vacuumized heat-insulating structure between the two containers 4 and 5, and an easy holdable curved shape which is a little shorter in diameter at center portion thereof than respective diameters in upper and lower portion thereof.

The cap body 3 includes a lid body 8 threadably and releasably mounted to a threaded portion 7 formed at a shoulder of the container body 2 and a cap 10 rotatively installed at the lid body 8 via a hinge axle 9. The lid body 8 comprises a lid plate 11 for blocking the opening of the container body 2 with a connection mouth 13 of a drinking straw member 12 and an air hole 14. The connection mouth 13 are respectively connected thereunder to a tube 15 for reaching a bottom of the container body 2 and connected thereon to the drinking straw member 12.

The drinking straw member 12 and the tube 15 are respectively made of flexible material and each has a cross-sectional view of a round circle, where the drinking straw member 12 is formed at a lower end of a straw unit 12*a* connected to the connection mouth 13 with a plate-shaped closing unit 12*b* for covering an upper portion of the air hole 14.

Between the connection mouth 13 of the lid plate 11 and the hinge axle 9, there is formed a recess 16 having an area smaller than that of the closing unit 12*b*. A flesh attaching unit 17 is formed around the air hole 14 at the recess 16. At an opposite position from the hinge axle 9 of the lid plate 11, there is disposed a hitching member 18 of the cap 10.

The dome-shape cap 10 includes a bend member 19 for contacting the straw unit 12*a* of the drinking straw member 12 to bend the straw unit 12*a* when the cap 10 is blocked, a blocking protruder 20 for blocking the air hole 14 via the closing unit 12*b* of the drinking straw member 12 and a hitching nail 21 for hitching to the hitching member 18.

The hitching member 18 having a button unit 22 and a hitching nail 23 is movably mounted toward the direction of the hinge axle 9.

The hitching member 18 keeps the cap 10 in a blocked state when the hitching nail 21 is hitched to another hitching nail 23 using resilience of synthetic resin tube 24, and by pressing the button unit 22 toward the hinge axle 9, hitched state between the two hitching members 21 and 23 is released to open the cap 10.

In the cap body 3 thus constructed, when the button unit 22 of the hitching member 18 is pressed, the cap 10 is made to be opened, and the straw unit 12*a* of the drinking straw member 12 that has been bent by the bend member 19 is erected by resilience thereof and a clearance is created between the air hole 14 and the closing unit 12*b* of the drinking straw member 12 pressed by the blocking protruder 20 to open the air hole 14, such that beverage in the container body 2 can be drunken from the straw unit 12*a*.

When the beverage is drunken to close the cap 10, the bend member 19 serves to bend the straw unit 12*a* of the drinking straw member 12 to be received by the cap 10 and simultaneously the blocking protruder 20 presses the closing unit 12*b* of the drinking straw member 12 to close the air hole 14. As a result, the cap 10 can be closed by one touch operation.

Furthermore, the air hole 14 is formed near to the hinge axle 9 and blocked via the plate-shaped closing unit 12*b* such that the air hole 14 can be fully blocked even with less accuracy of parts involved thereon. The air hole 14 is formed on a recess 16 of smaller area than that of the closing unit 12*b*, whereby the closing unit 12*b* is vertically descended by its own weight when the cap 10 is opened, thereby preventing the air hole 14 from being blocked. The flesh attaching unit 17 is formed around the air hole 14 where the air hole 14 is arranged thereon such that it is possible to perform a definite blocking operation of the air hole 14.

Figure 5:
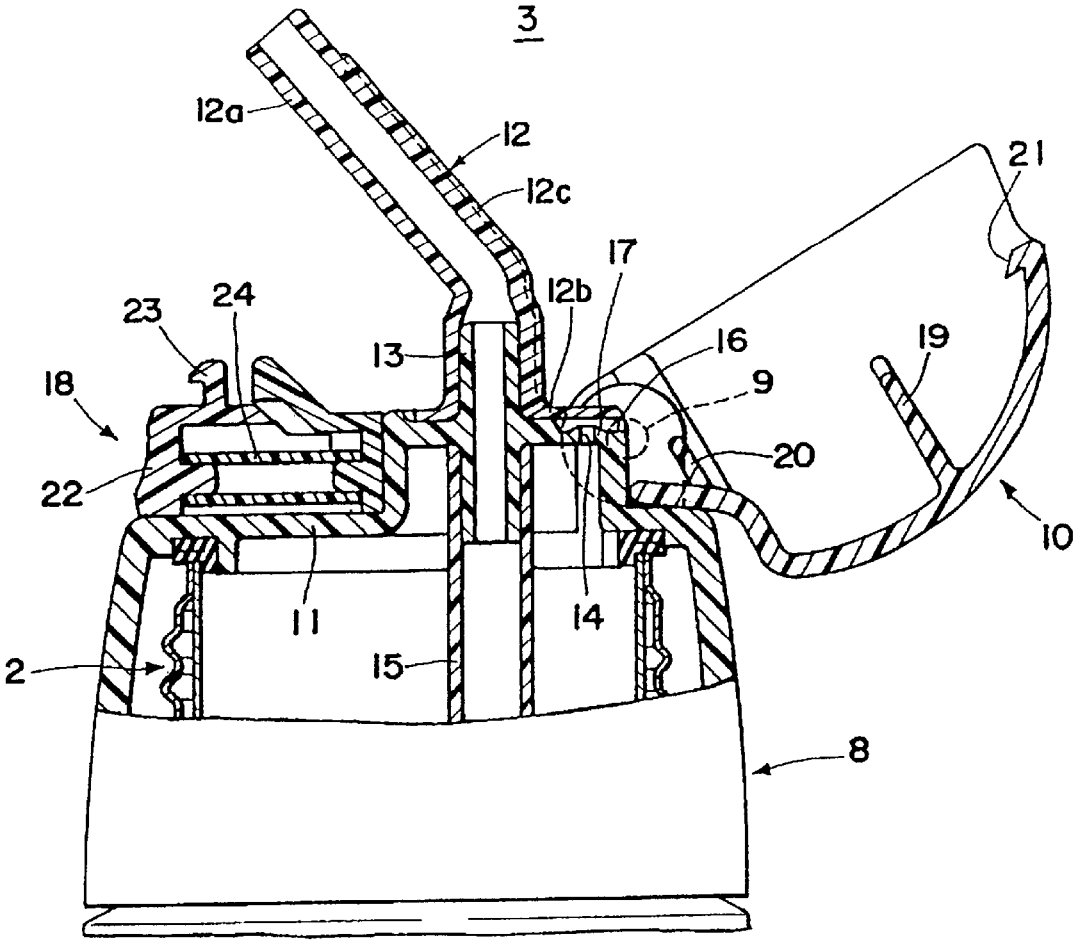
FIG. 5 is a sectional view of a cap body where a cap is opened according to a second embodiment of the present invention.
Figure 6:
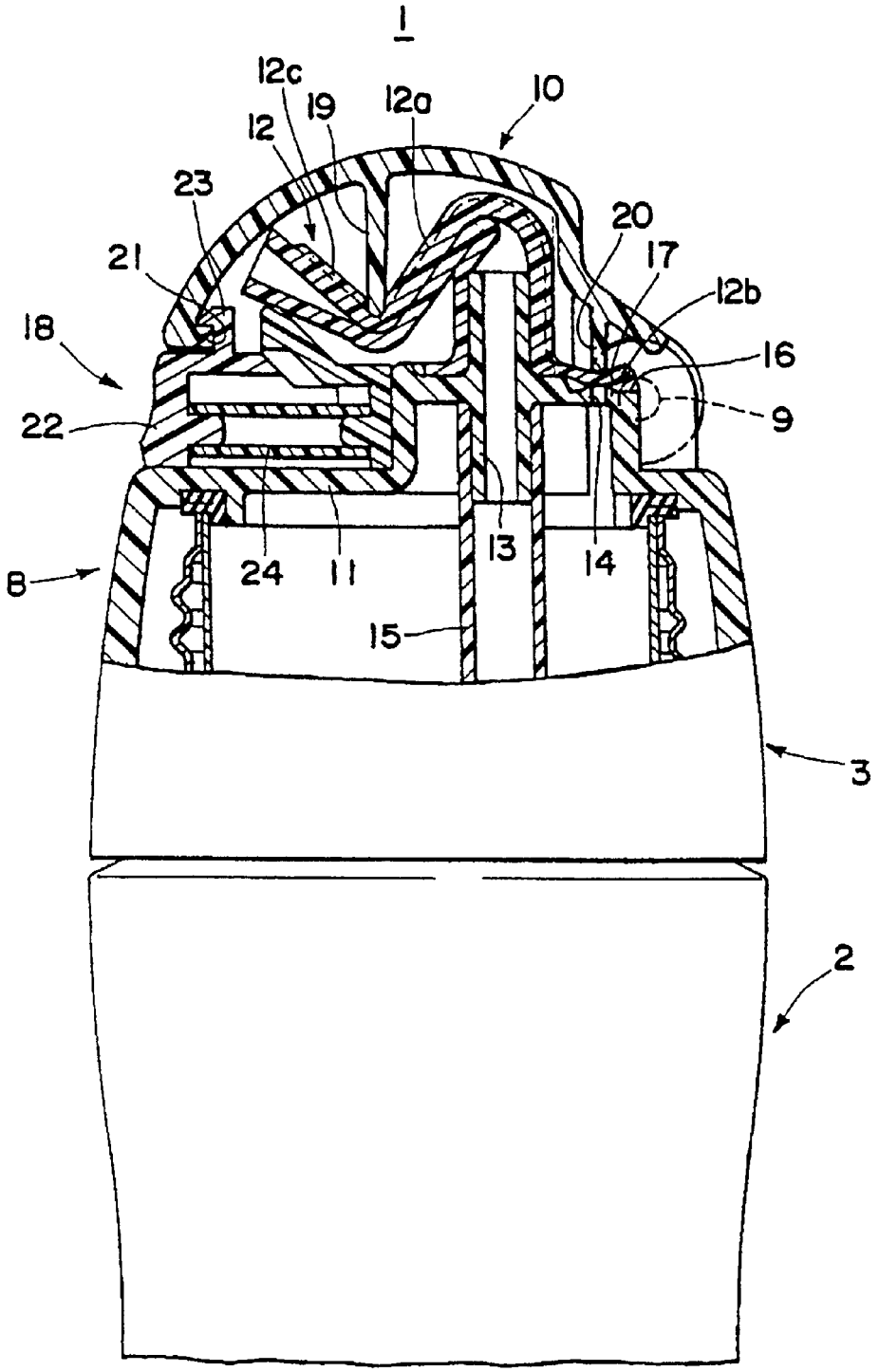
FIG. 6 is a sectional view of a cap body where a cap is closed according to the second embodiment of the preset invention.
Figure 7:
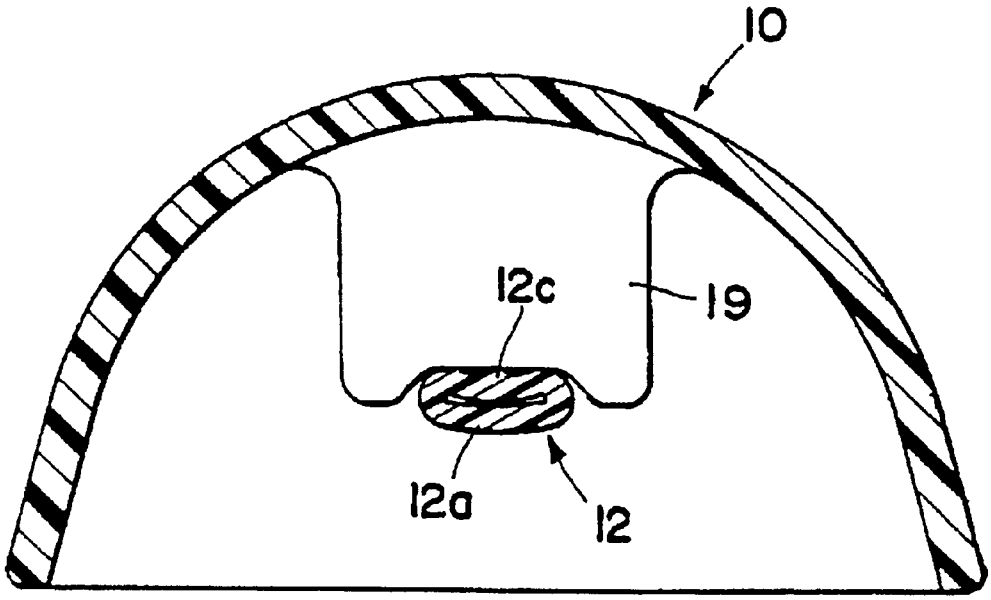
FIG. 7 is a sectional view where a drinking straw member according to the second embodiment is bent by a bending member.

FIGS. 5 to 7 disclose the second embodiment of the present invention. Throughout the drawings, like reference numerals are used as in the first embodiment for designation of like or equivalent parts or portions and explanation thereto will be omitted.

In the second embodiment, a prominent unit 12*c* is formed along the axial direction of the straw unit 12*a* at an area where the bend member 19 of the straw unit 12*a* at the drinking straw member 12 contacts.

When the cap 10 is closed in the structure thus described, the bend member 19 comes in touch with the prominent unit 12*c* disposed along the axial direction of the straw unit 12*a* to thereby bend the straw unit 12*a*.

Furthermore, contacted area between the bend member 19 and the straw unit 12*a* becomes smaller until the straw unit 12*a* is almost blocked, thereby making resistance small by which the cap 10 can be closed with less force applied thereto.

Even when the button unit 22 is pressed to open the cap 10, friction between the bend member 19 and the straw unit 12*a* becomes smaller, enabling to open the cap 10 smoothly and in a short period of time as well. As a result, it is possible to use a soft material for the drinking straw member 12 and breath of freedom of discretion in selecting material thereof can be expanded, whereby a full bending of the drinking straw member 12 is possible at the same time.

As apparent from the foregoing, there is an advantage in the cap body of beverage container thus described according to the present invention in that a lid plate at a lid body formed with connection mouth of a drinking straw member is disposed with an air hole between a hinge axle rotatively supporting a cap and the connection mouth, and a closing unit for covering the air hole is formed at a lower end of a straw unit for connecting the connection mouth at the drinking straw member, while the cap is mounted with a bend member for bending the drinking straw member, and a blocking protruder for blocking the air hole via the closing unit, such that when the cap is closed, the bend member bends the drinking straw member to be accommodated into the cap and concurrently the blocking protruder presses the blocking unit of the drinking straw member to close the air hole, thereby enabling to close the cap with one-touch operation.

There is another advantage in that the air hole is positioned near at a hinge axle and is blocked via the plate-shaped closing unit of the drinking straw member, whereby there occurs no twist and a complete blocking of air hole is possible even with less accuracy of quality.

There is still another advantage in that a prominent unit is formed along the axial direction of a straw unit at an area where a bend member of the straw unit at a drinking straw member contacts, such that the bend member comes in touch with the prominent unit disposed along the axial direction of the straw unit to thereby bend the straw unit, whereby contacted area between the bend member and the straw unit becomes smaller until the straw unit is almost blocked, thereby making resistance small to allow the cap to be closed with less force applied thereto, and to cause the cap to be smoothly and instantly opened because of smaller friction between the bend member and the drinking straw member.

There is still further advantage in that the drinking straw member can be made of soft material whereby breath of freedom of discretion in selecting material thereof can be expanded and simultaneously it is possible to fully bend the drinking straw member.

There is still further advantage in that the air hole is formed on a recess of smaller area than that of the closing unit whereby the closing unit is vertically descended by its own weight when the cap is opened, thereby preventing the air hole from being blocked.

There is still further advantage in that a flesh attaching unit is formed around the air hole, making it possible to perform a sure definite blocking operation.

What is claimed is:

1. A cap body of a beverage container having container body defining an opening, the cap body comprising:

a) a lid body threadably and releasably mounted at said opening of said container body and having a lid plate for blocking said opening;

b) a cap rotatably mounted at said lid via a hinge axis for covering said lid plate and having a bending member and a closing protruder;

c) said lid plate having an air hole and a connection mouth that is connected to a drinking straw member, said air hole located between said connection mouth and said hinge axis; and d) a plate-shaped closing unit formed at a lower end of said drinking straw member for covering an upper portion of said air hole;

whereby when the cap closed, said drinking straw member is bent by said bending member and said air hole is simultaneously blocked by said closing protruder via said closing unit.

2. The cap busy as claimed in claim 1, wherein said lid plate is formed with a recess forming a space between said air hole and the lower end of said drinking straw member, there being a lip around said air hole at said recess having an area smaller than that of said closing unit.

3. A cap body of a beverage container having a container body defining an opening, the cap body comprising:

a) a lid body theadably and releasably mounted at said opening of said container body and having a lid plate for blocking and opening;

b) a cap rotatably mounted at said lid body via a hinge axis for covering said lid plate and having a bending member and a closing protruder;

c) said lid plate having an air hole and a connection mouth that is connected to a drinking straw member, said air hole located between said connection mouth and said hinge axis, and said drinking straw member having a prominent unit formed along an axial direction of said drinking straw member for contact with said bending member;

whereby when said cap is closed, said air hole is blocked by said closing protruder and said drinking straw member is simultaneously bent by said closing protruder and said drinking straw member is simultaneously bent by said bending member contracting said prominent unit.

4. The cap body as claimed in claim 3, including a plate-shaped closing unit formed at a lower end of said drinking straw member for covering an upper portion of said air hole.

5. The cap body as claimed in claim 4, wherein said lid plate is formed with a recess forming a space between said air hole and the lower end of said drinking straw member, there being a lip around said air hole at said recess and said recess having an area smaller than that of said closing unit.

* * * * *